US006628250B1

(12) United States Patent
Yoo et al.

(10) Patent No.: US 6,628,250 B1
(45) Date of Patent: Sep. 30, 2003

(54) METHOD FOR DRIVING PLASMA DISPLAY PANEL

(75) Inventors: Ji-seung Yoo, Yongin (KR); sang-chul Kim, Cheonan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/542,462

(22) Filed: Apr. 4, 2000

(30) Foreign Application Priority Data

Jun. 28, 1999 (KR) ..... 99-24746

(51) Int. Cl.[7] ..... G09G 3/28
(52) U.S. Cl. ..... 345/60; 345/67
(58) Field of Search ..... 345/60, 66, 67

(56) References Cited

U.S. PATENT DOCUMENTS 4,044,349 A * 8/1977 Andoh et al. ..... 340/324 M
4,638,218 A * 1/1987 Shinoda et al. ..... 315/169.4
4,737,687 A * 4/1988 Shinoda et al. ..... 315/169.4
5,663,741 A * 9/1997 Kanazawa ..... 345/66
5,854,540 A * 12/1998 Matsumoto et al. ..... 315/169.1
6,292,160 B1 * 9/2001 Mikoshiba et al. ..... 345/60
6,373,452 B1 * 4/2002 Ishii et al. ..... 315/169.4

* cited by examiner

*Primary Examiner*—Richard Hjerpe
*Assistant Examiner*—Kevin M. Nguyen
(74) *Attorney, Agent, or Firm*—Leydig, Voit & Mayer, Ltd.

(57) ABSTRACT

A method for driving a plasma display panel having a front substrate and a rear substrate facing and spaced apart from each other, and n common electrode lines, n scan electrode lines, and m address electrode lines arranged between the front and rear substrates (m and n are integers greater than 1), the common electrode lines and the scan electrode lines being parallel to each other, the address electrode lines being orthogonal to the scan electrode lines, to define pixels at respective intersections, the method including, (1) in order to distribute the n common electrode lines to k common electrode groups (k is an integer of greater than or equal to 2), setting (p+k·j)th common electrode lines in the p-th common electrode group (p is an integer and at least 1 and j is any integer, (2) dividing a unit frame to be displayed into k subfields, and (3) applying a relatively high discharge voltage to the electrode lines of the p-th common electrode group in the p-th subfield, among respective subfields, thereby erasing wall charges formed at the pixels and forming uniform space charges.

2 Claims, 9 Drawing Sheets

METHOD FOR DRIVING PLASMA DISPLAY PANEL

BACKGROUND OF THE INVENTION

1. Field of the Invention

The present invention relates to a method for driving a plasma display panel, and more particularly, to a method for driving a three-electrode surface-discharge alternating-current plasma display panel.

2. Description of the Related Art

FIG. 1 shows a structure of a general three-electrode surface-discharge alternating-current plasma display panel, FIG. 2 shows an electrode line pattern of the panel shown in FIG. 1, and FIG. 3 shows another example of a pixel of the panel shown in FIG. 1. Referring to the drawings, address electrode lines $A_1, A_2, A_3, \ldots, A_{m-2}, A_{m-1}$ and $A_m$, a dielectric layer 11 (and/or 141 of FIG. 3), scan electrode lines $Y_1, Y_2, \ldots, Y_{n-1}$ and $Y_n$, common electrode lines $X_1, X_2, \ldots, X_{n-1}$ and $X_n$ and a MgO protective film 12 are provided between front and rear glass substrates 10 and 13 of a general surface-discharge plasma display panel 1.

The address electrode lines $A_1, A_2, A_3, \ldots, A_{m-2}, A_{m-1}$ and $A_m$, are arranged on the entire surface of the rear glass substrate 13 in a predetermined pattern. Phosphors (142 of FIG. 3) may coat the entire surface of the scan electrode lines $Y_1, Y_2, Y_{n-1}$ and $Y_n$. Otherwise, the phosphors 142 may coat a dielectric layer 141 in the event the dielectric layer 141 coats the entire surface of the scan electrode lines $Y_1, Y_2, \ldots, Y_{n-1}$ and $Y_n$ in a predetermined pattern.

The common electrode lines $X_1, X_2, \ldots, X_{n-1}$ and $X_n$ and the scan electrode lines $Y_1, Y_2, \ldots, Y_{n-1}$ and $Y_n$ are arranged on the rear surface of the front glass substrate 10, orthogonal to the address electrode lines $A_1, A_2, A_3, \ldots, A_{m-2}, A_{m-1}$ and $A_m$, in a predetermined pattern. The respective intersections define corresponding pixels. The common electrode lines $X_1, X_2, \ldots, X_{n-1}$ and $X_n$ and the scan electrode lines $Y_1, Y_2, \ldots, Y_{n-1}$ and $Y_n$ each comprise of indium tin oxide (ITO) electrode lines $X_{na}$ and $Y_{na}$, and metal bus electrode lines $X_{nb}$ and $Y_{nb}$, as shown in FIG. 3. The dielectric layer 11 entirely covers the rear surface of the common electrode lines $X_1, X_2, \ldots, X_{n-1}$ and $X_n$ and the scan electrode lines $Y_1, Y_2, \ldots, Y_{n-1}$ and $Y_n$. The MgO protective film 12 for protecting the panel 1 against strong electrical fields entirely coats the rear surface of the dielectric layer 11. A gas for forming plasma is hermetically sealed in a discharge space.

The driving method generally adopted for the plasma display panel described above is an address/display separation driving method in which a reset step, an address step and a sustain-discharge step are sequentially performed in a unit subfield. In the reset step, wall charges remaining in the previous subfield are erased. In the address step, the wall charges are formed in a selected pixel area. Also, in the sustain-discharge step, light is produced at the pixel at which the wall charges are formed in the address step. In other words, if alternating pulses of a relatively high voltage are applied between the common electrode lines $X_1, X_2, \ldots, X_{n-1}$ and $X_n$ and the scan electrode lines $Y_1, Y_2, \ldots, Y_{n-1}$ and $Y_n$, a surface discharge occurs at the pixel at which the wall charges are formed. Here, a plasma is formed at the gas layer of the discharge space 14 and the phosphors 142 are excited by ultraviolet rays to thus emit light.

Here, several unit subfields basically operating on the principles as described above are contained in a unit frame, thereby achieving a desired gray scale display by sustain-discharge time intervals of the respective subfields.

In the above-described method for driving the plasma display panel 1, conventionally, a relatively high discharge voltage is applied to all common electrode lines $X_1, X_2, \ldots, X_{n-1}$ and $X_n$ in the reset step, thereby erasing wall charges formed at the pixels in the previous subfields and generating a uniform space charge. However, according to the conventional driving method, since erasing discharge occurs around all common electrode lines $X_1, X_2, \ldots, X_{n-1}$ and $X_n$, the contrast of a screen is deteriorated.

SUMMARY OF THE INVENTION

To solve the above problem, it is an objective of the present invention to provide a method for driving a plasma display panel which can increase the contrast of the plasma display panel.

Accordingly, to achieve the above objective, there is provided a method for driving a plasma display panel having a front substrate and a rear substrate facing and spaced apart from each other, and n common electrode lines, n scan electrode lines and m address electrode lines arranged between the front and rear substrates (m and n are integers of greater than or equal to 2), the common electrode lines and the scan electrode lines being parallel to each other, the address electrode lines being arranged to be orthogonal to the scan electrode lines, to define pixels at the respective intersections, the method including the steps of (1) in order to distribute the n common electrode lines to k common electrode groups (k is an integer of greater than or equal to 2), setting (p+k·j)th common electrode lines to be included in the p-th common electrode group (p is an integer of greater than or equal to 1 and j is an integer of greater than or equal to 0), (2) setting a unit frame to be displayed into k subfields, and (3) applying a relatively high discharge voltage to the electrode lines of the p-th common electrode group in the p-th subfield among the respective subfields, thereby erasing wall charges formed at the pixels and forming uniform space charges.

According to the driving method of the present invention, a relatively high discharge voltage is applied to only electrode lines of the corresponding common electrode group in each subfield. Accordingly, since an erase discharge takes place only around the electrode lines of the corresponding common electrode group, the contrast of a screen can be further enhanced. Also, since the (p+k·j)th common electrode lines are set to be included in the p-th common electrode group, an erase discharge occurs with a constant time interval with respect to all areas in the discharge space. Accordingly, the effect of the erase discharge is maintained and no flicker is generated.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 1:
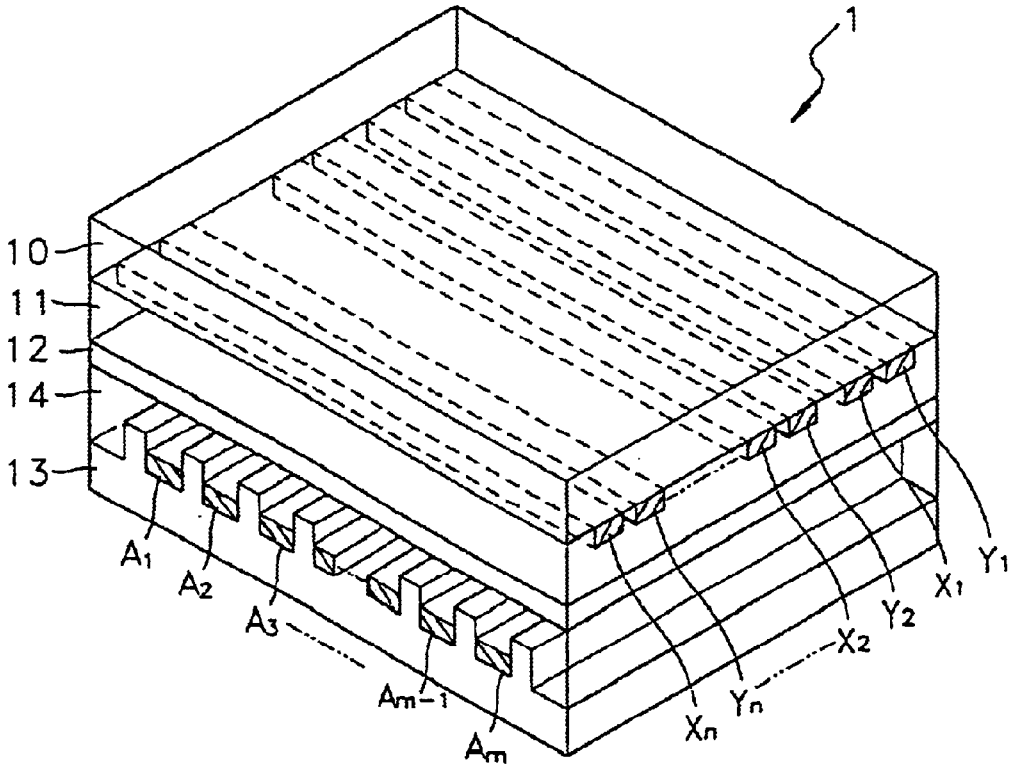
FIG. 1 PRIOR ART
FIG. 1 shows a structure of a general three-electrode surface-discharge alternating-current plasma display panel.
Figure 2:
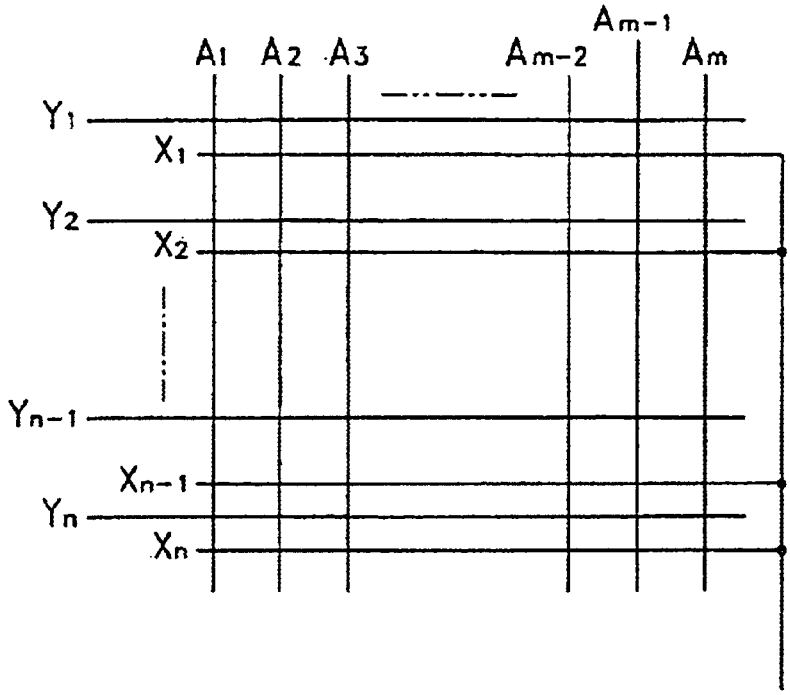
FIG. 2 PRIOR ART
FIG. 2 shows an electrode line pattern of the panel shown in FIG. 1.
Figure 3:
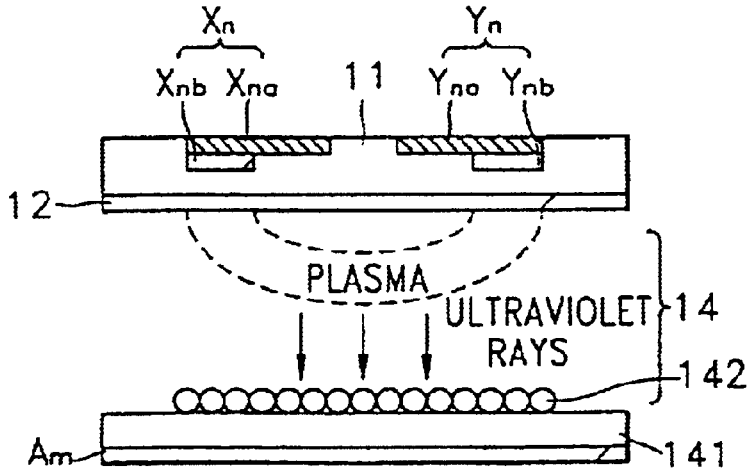
FIG. 3 PRIOR ART
FIG. 3 is a cross section of another example of a pixel of the panel shown in FIG. 1.
Figure 4:
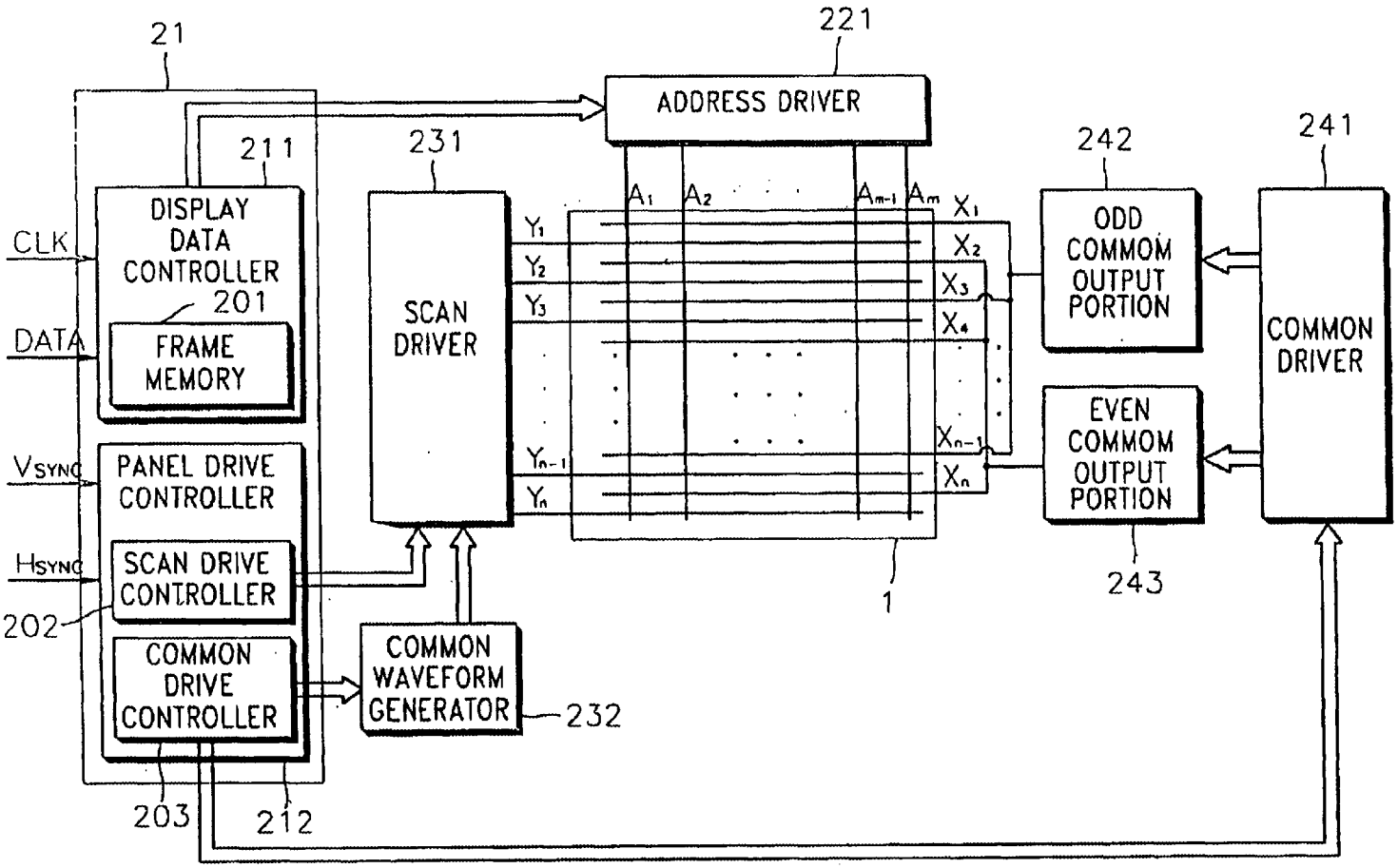
FIG. 4 is a block diagram of a driving apparatus for implementing a first embodiment of the present invention.
Figure 5A:
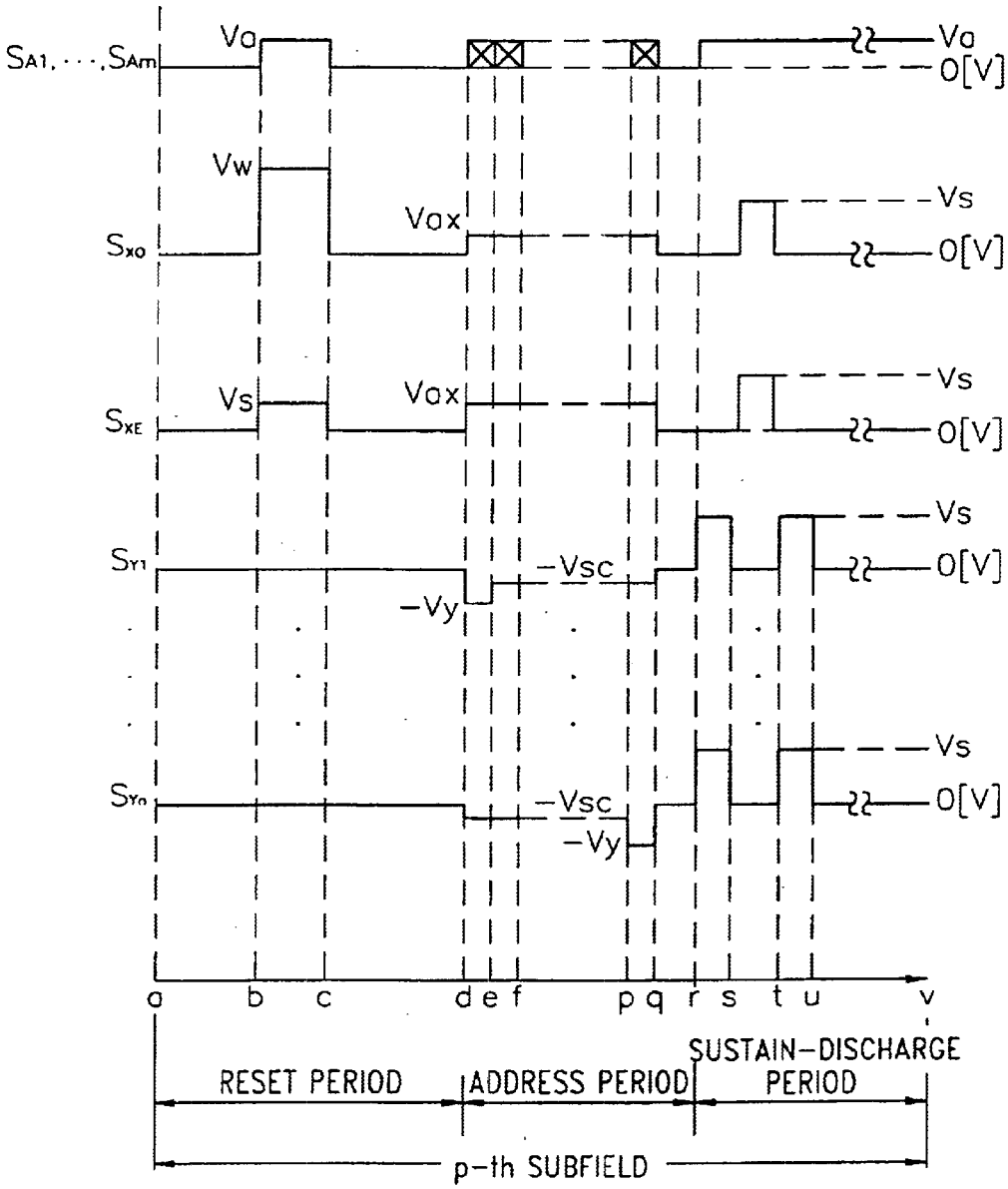
FIGS. 5A and 5B are waveform diagrams of voltages applied from the driving apparatus shown in FIG. 4 to the respective electrode lines of a plasma display panel according to the first embodiment of the present invention.
Figure 5B:
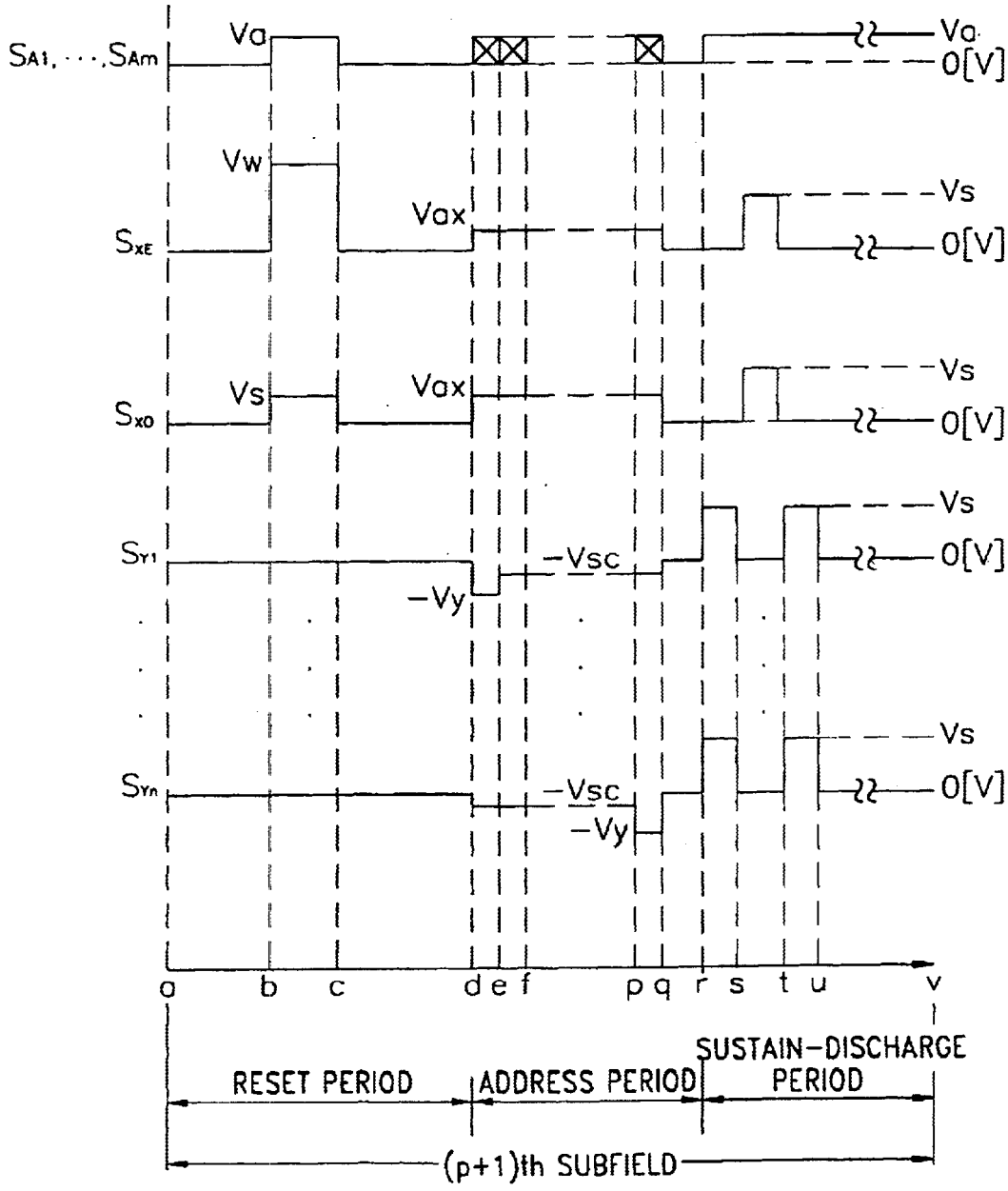

FIG. 4 is a block diagram of a driving apparatus for implementing a first embodiment of the present invention, and FIGS. 5A and 5B are waveform diagrams of voltages applied from the driving apparatus shown in FIG. 4 to the respective electrode lines of a plasma display panel (PDP) according to the first embodiment of the present invention.

Referring to FIG. 4, the driving apparatus according to a first embodiment of the present invention includes a controller 21, an address driver 221, a common waveform generator 232, a scan driver, a common driver 241, an odd common output portion 242 and an even common output portion 243. The odd common electrode lines $X_1, X_3, \ldots, X_{n-1}$ of the PDP 1 are connected in common to the output port of the odd common output portion 242. The even common electrode lines $X_2, X_4, \ldots, X_n$ of the PDP 1 are connected in common to the output port of the even common output portion 243. The respective scan electrode lines $Y_1, Y_2, \ldots, Y_{n-1}$ and $Y_n$ of the PDP 1 are connected to the corresponding output ports of the scan driver 231. The address electrode lines $A_1, A_2, A_3, \ldots, A_{m-2}, A_{m-1}$ and $A_m$ are connected to the corresponding output ports of the address driver 221.

The controller 21 including a display data controller 211 and a panel drive controller 212, receives from a host, e.g., a notebook-type computer, a clock signal CLK, a data signal DATA, a vertical synchronization signal $V_{SYNC}$ and a horizontal synchronization signal $H_{SYNC}$. The display data controller 211 stores the data signal DATA in a frame memory 201 provided therein according to the clock signal CLK and applies the corresponding address control signal to the address driver 221. The panel drive controller 212 for processing the vertical synchronization signal $V_{SYNC}$ and the horizontal synchronization signal $H_{SYNC}$ includes a scan drive controller 202 and a common drive controller 203. The scan drive controller 202 generates signals for controlling the scan driver 231 and the common drive controller 203 generates signals for controlling the common waveform generator 232 and the common driver 241. The common driver 241 applies the corresponding drive control signals to the respective common output portions 242 and 243. Accordingly, the odd common output portion 242 outputs drive signals corresponding to the odd common electrode lines $X_1, X_3, \ldots, X_{n-1}$ and the even common output portion 243 outputs drive signals corresponding the even common electrode lines $X_2, X_4, \ldots, X_n$.

FIG. 5A shows waveforms of voltages applied to the respective electrode lines of the PDP (1 of FIG. 4) in the p-th subfield (p is an odd number). In FIG. 5A, $S_{A1}, \ldots, S_{Am}$ denote address drive signals applied from the address driver (221 of FIG. 4) to the respective address electrode lines $A_1, A_2, A_3, \ldots, A_{m-2}, A_{m-1}$ and $A_m$. $S_{XO}$ denotes odd common drive signals applied from the odd common output portion (242 of FIG. 4) to the odd common electrode lines $X_1, X_3, \ldots$ and $X_{n-1}$, and $S_{XE}$ denotes even common drive signals applied from the even common output portion (243 of FIG. 4) to the even common electrode lines $X_2, X_4, \ldots$ and $X_n$. $S_{Y1}, \ldots, S_{ym}$ are scan drive signals applied from the scan driver (231 of FIG. 4) to the corresponding scan electrode lines $Y_1, Y_2, \ldots$ and $Y_{n-1}$, and $Y_n$.

Referring to FIG. 5A, in a section (b-c) of a reset period (a-d), a voltage Va of positive polarity is applied to all address electrode lines $A_1, A_2, A_3, \ldots, A_{m-2}, A_{m-1}$ and $A_m$, and 0 volt is applied to all scan electrode lines $Y_1, Y_2, \ldots$ and $Y_{n-1}$ and $Y_n$. Also, an erase discharge voltage Vw having a positive polarity is applied to the odd common electrode lines $X_1, X_3, \ldots$ and $X_{n-1}$, and a sustain-discharge voltage Vs having a positive polarity is applied to the even common electrode lines $X_2, X_4, \ldots$ and $X_n$. Accordingly, an erase discharge is carried out only around the odd common electrode lines $X_1, X_3, \ldots$ and $X_{n-1}$, so that wall charges accumulate around the corresponding electrode lines. Here, the sustain-discharge voltage Vs applied to the even common electrode lines $X_2, X_4, \ldots$ and $X_n$ has the same polarity as and a lower level than the erase discharge voltage Vw applied to the odd common electrode lines $X_1, X_3, \ldots$ and $X_{n-1}$. In other words, since a difference between the sustain-discharge voltage Vs and the erase discharge voltage Vw is relatively small, no discharge takes place between the odd common electrode lines $X_1, X_3, \ldots$ and $X_{n-1}$ and the even common electrode lines $X_2, X_4, \ldots$ and $X_n$. In a section (c-d) of the reset period (a-d), 0V is applied to all electrode lines. Accordingly, wall charges having accumulated on the electrode lines are erased by self-discharge and space charges are uniformly formed.

In a section (d-e) of an address period (d-r), a corresponding address drive voltage is applied to the address electrode lines $A_1, A_2, A_3, \ldots, A_{m-2}, A_{m-1}$ and $A_m$, and a scan drive voltage −Vy is applied to the first scan electrode line $Y_1$, and a positive polarity voltage Vax of a relatively low level is applied to all common electrode lines $X_1, X_2, \ldots, X_{n-1}$ and $X_n$. Accordingly, with respect to the first scan electrode line $Y_1$, an address discharge is carried out at pixels of intersections between the first scan electrode line $Y_1$ and the address electrode lines $A_1, A_2, A_3, \ldots, A_{m-2}, A_{m-1}$ and $A_m$, thereby forming wall charges.

The address process, as in the section (d-3) of the address period (d-r), is repeatedly performed in sequence. In a section (p-q) of the address period (d-r), a corresponding address drive voltage is applied to the address electrode lines $A_1, \ldots,$ and $A_m$ to which a selected address voltage Va is applied, and a scan drive voltage −Vy is applied to the n-th scan electrode line $Y_n$, and a positive polarity voltage Vax of a relatively low level is applied to all common electrode lines $X_1, X_2, \ldots, X_{n-1}$ and $X_n$. Accordingly, with respect to the n-th scan electrode line $Y_n$, an address discharge is carried out at pixels at intersections between the first scan electrode line $Y_1$ and the address electrode lines $A_1, \ldots,$ and $A_m$ to which a selected address voltage Va is applied, thereby forming wall charges.

When the address period (d-r) is terminated, the formation of wall charges at selected pixels is completed. Accordingly, the sustain-discharge voltage Vs is alternately applied between all scan electrode lines $Y_1, \ldots$ and $Y_n$ and all common electrode lines $X_1, \ldots$ and $X_n$ in a subsequent sustain-discharge period (r-v), thereby performing a sustain discharge at pixels where wall charges have been formed in the address period (d-r). Here, a common signal to be applied to the scan electrode lines $Y_1, \ldots$ and $Y_n$ is generated by the common waveform generator (232 of FIG.

4). In the sustain-discharge period (r-v), the selected address voltage Va of a relatively low level is applied to all address electrode lines $A_1, \ldots,$ and $A_m$, thereby increasing sustain-discharge efficiency.

FIG. 5B shows waveforms of voltages applied to the respective electrode lines of the PDP (1 of FIG. 4) in the (p+1)th subfield (p is an odd number). In detail, FIG. 5A is a waveform diagram of voltages applied to odd subfields and FIG. 5B is a waveform diagram of voltages applied to even subfields. In FIG. 5B, the same symbols as those in FIG. 5A are elements having the same function. The waveforms shown in FIGS. 5A and 5B are different in each section (b-c) of a reset period (a-d). In other words, in a section (b-c) of a reset period (a-d) for even subfields, an erase discharge voltage Vw having a positive polarity is applied to the even common electrode lines $X_2, X_4, \ldots$ and $X_n$, and a sustain discharge voltage Vs having a positive polarity is applied to the odd common electrode lines $X_1, X_3, \ldots$ and $X_{n-1}$. Accordingly, an erase discharge is carried out only around the even common electrode lines $X_2, X_4, \ldots$ and $X_n$, so that wall charges accumulate around the corresponding electrode lines. In a section (c-d) of a reset period (a-d), 0V is applied to all electrode lines. Accordingly, the wall charges having accumulated on the electrode lines are erased by a self-discharge and space charges are uniformly formed.

To sum up, according to the first embodiment of the present invention, a relatively high discharge voltage is applied to only electrode lines of the corresponding common electrode group in each subfield. Accordingly, since an erase discharge takes place only around the electrode lines of the corresponding common electrode group, the contrast of a screen can be further enhanced. Since a erase discharge voltage Vw is alternately applied to the even common electrode lines $X_2, X_4, \ldots$ and $X_n$, and the odd common electrode lines $X_1, X_3, \ldots$ and $X_{n-1}$, an erase discharge occurs with a constant time interval with respect to all areas in the discharge space. Accordingly, the effect of the erase discharge is maintained and no flicker is generated.

Figure 6:
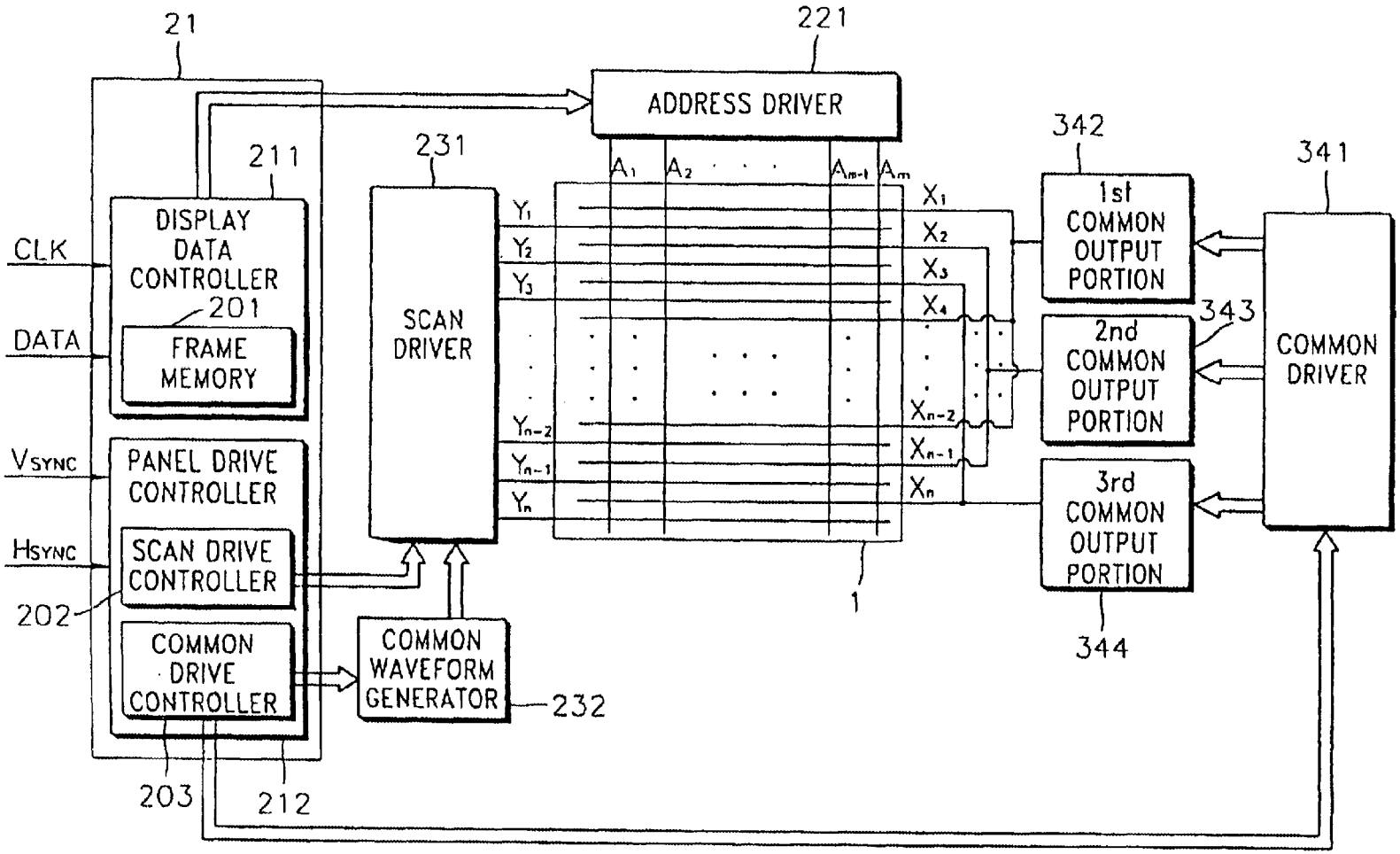
FIG. 6 is a block diagram of a driving apparatus for implementing a second embodiment of the present invention.
Figure 7A:
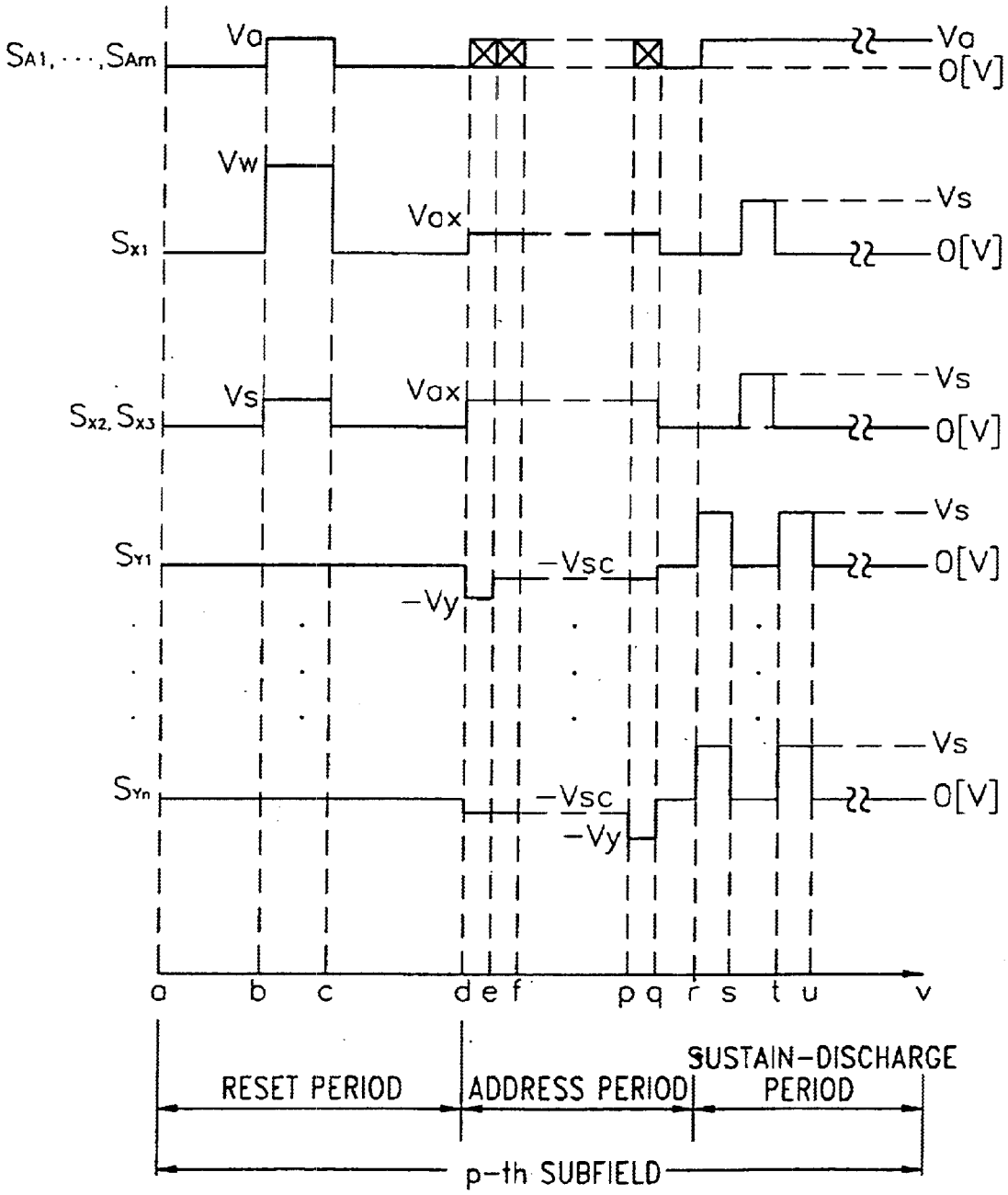
FIGS. 7A, 7B and 7C are waveform diagrams of voltages applied from the driving apparatus shown in FIG. 6 to the respective electrode lines of a plasma display panel according to the second embodiment of the present invention.
Figure 7B:
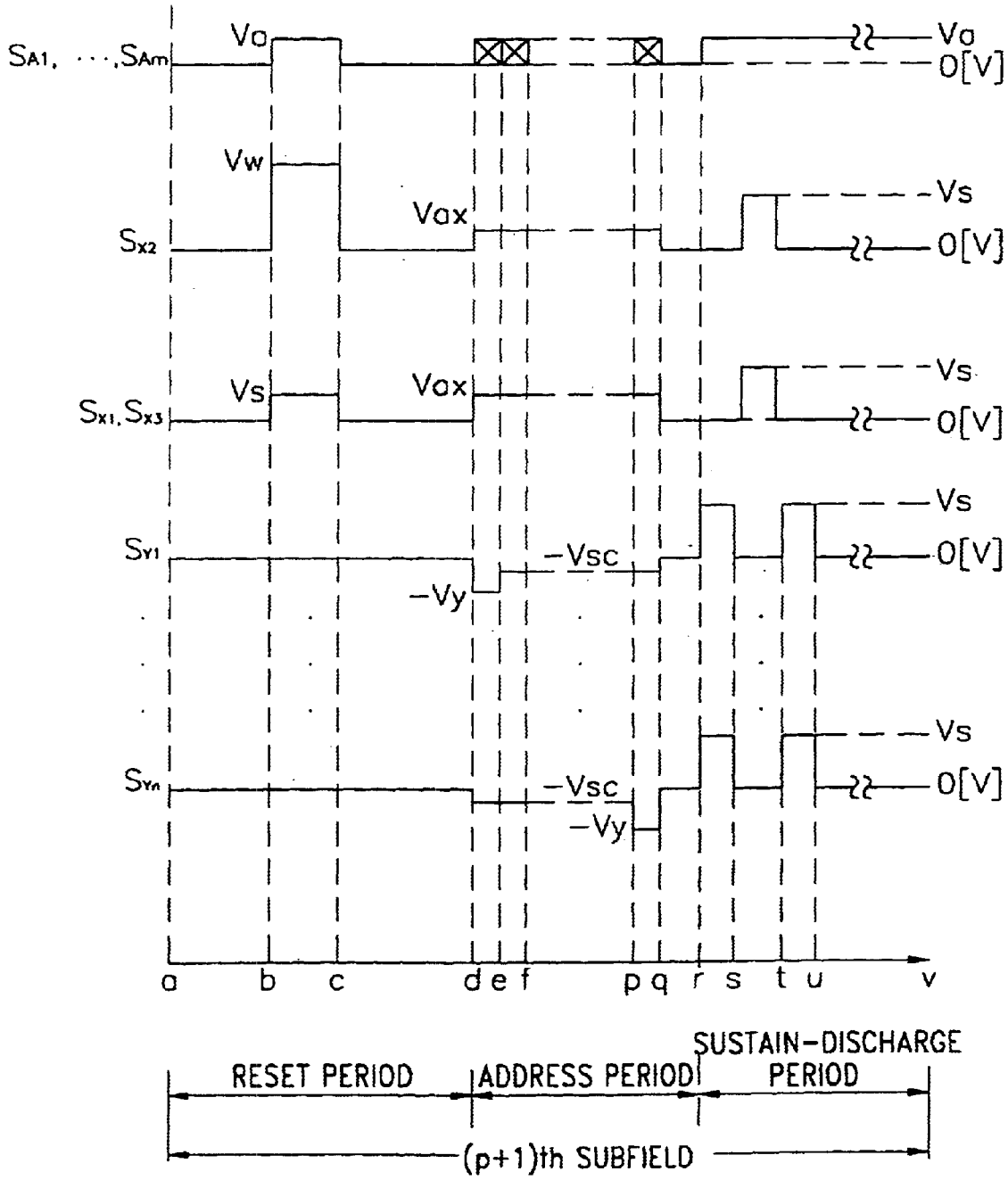
Figure 7C:
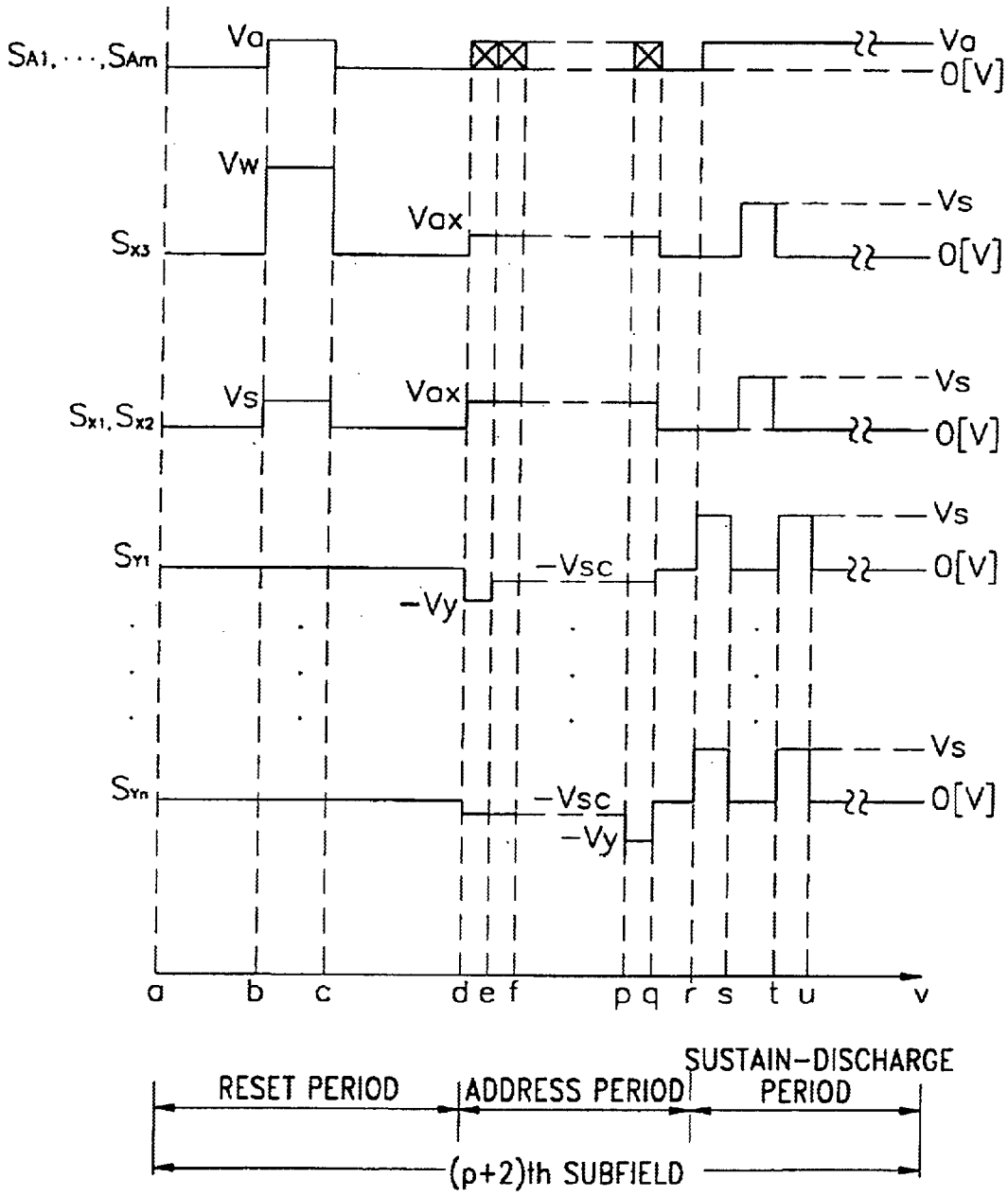

FIG. 6 shows a driving apparatus for implementing a second embodiment of the present invention. FIGS. 7A, 7B and 7C are waveform diagrams of voltages applied from the driving apparatus shown in FIG. 6 to the respective electrode lines of a plasma display panel according to the second embodiment of the present invention.

In FIG. 6, the same symbols as those in FIG. 4 are elements having the same function. The apparatus shown in FIG. 4 is different in that three common output portions 342, 343 and 344 are provided in the apparatus shown in FIG. 6. In other words, the first common output portion 342 outputs driving signals corresponding to electrode lines of a first common electrode group, $X_1, X_4, \ldots$ and $X_{n-2}$, the second common output portion 343 outputs driving signals corresponding to electrode lines of a second common electrode group, $X_2, X_5, \ldots$ and $X_{n-1}$, and the third common output portion 343 outputs driving signals corresponding to electrode lines of a third common electrode group, $X_3, X_6, \ldots$ and $X_n$.

In order to distribute n common electrode lines to the three common output portions 342, 343 and 344, (1+3j)th common electrode lines $X_1, X_4, \ldots$ and $X_{n-2}$ are connected to the first common output portion 342 (0 is an integer greater than or equal to 0). Also, (2+3j)th common electrode lines $X_2, X_5, \ldots$ and $X_1$ are connected to the second common output portion 342. (3+3j)th common electrode lines $X_3, X_6, \ldots$ and $X_n$ are connected to the third common output portion 343. This is generalized such that in order to distribute n common electrode lines to k common electrode groups (k is an integer of greater than or equal to 2), (p+k·j)th common electrode lines are set to be included in the p-th common electrode line group (p is an integer of greater than or equal to 1).

FIG. 7A shows waveforms of voltages applied to the respective electrode lines of the PDP (1 of FIG. 4) in the p-th subfield. In FIG. 7A, the same symbols as those in FIG. 5A are elements having the same function. The waveforms shown in FIGS. 5A and 7A are different in that there are three common drive signals $S_{X1}$, $S_{X2}$ and $S_{X3}$ for FIG. 7A. In other words, in a section (b-c) of a reset period (a-d) for the p-th subfield, an erase discharge voltage Vw of a positive polarity is applied to the electrode lines of a first common electrode group, $X_1, X_4, \ldots$ and $X_{n-2}$, and a sustain discharge voltage Vs of a positive polarity is applied to the other common electrode lines $X_2, X_5 \ldots$ and $X_{n-1}$, and $X_3, X_6, \ldots$ and $X_n$. Accordingly, an erase discharge is carried out only around the first common electrode lines $X_1, X_4, \ldots$ and $X_{n-2}$, so that wall charges accumulate around the corresponding electrode lines. In a section (c-d) of a reset period (a-d), 0V is applied to all electrode lines. Accordingly, the wall charges having accumulated on the electrode lines are erased by a self-discharge and space charges are uniformly formed.

FIG. 7B shows waveforms of voltages applied to the respective electrode lines of the PDP (1 of FIG. 4) in the (p+1)th subfield. In FIG. 7B, the same symbols as those in FIG. 7A are elements having the same function. The waveforms shown in FIGS. 7A and 7B are different in each section (b-c) of a reset period (a-d). In tE other words, in a section (b-c) of a reset period (a-d) for the (p+1)th subfield, an erase discharge voltage VW having a positive polarity is applied to the electrode lines of a second common electrode group, $X_2, X_5, \ldots$ and $X_{n-1}$, and a sustain discharge voltage Vs having a positive polarity is applied to the other common electrode lines $X_1, X_4, \ldots$ and $X_{n-2}$, and $X_3, X_6, \ldots$ and $X_n$. Accordingly, an erase discharge is carried out only around the second common electrode lines $X_2, X_5, \ldots$ and $X_{n-1}$, so that wall charges accumulate around the corresponding electrode lines. In a section (c-d) of a reset period (a-d), 0V is applied to all electrode lines. Accordingly, the wall charges having accumulated on the electrode lines are erased by a self-discharge and space charges are uniformly formed.

FIG. 7C shows waveforms of voltages applied to the respective electrode lines of the PDP (1 of FIG. 4) in the (p+2)th subfield. In FIG. 7C, the same symbols as those in FIG. 7B are elements having the same function. The waveforms shown in FIGS. 7B and 7C are different in each section (b-c) of a reset period (a-d). In other words, in a section (b-c) of a reset period (a-d) for the (p+2)th subfield, an erase discharge voltage Vw, having a positive polarity is applied to the electrode lines of a third common electrode group, $X_3, X_6, \ldots$ and $X_n$, and a sustain discharge voltage Vs having a positive polarity is applied to the other common electrode lines $X_1, X_4, \ldots$ and $X_{n-2}$, and $X_2, X_5, \ldots$ and $X_{n-1}$. Accordingly, an erase discharge is carried out only around the third common electrode lines $X_3, X_6, \ldots$ and $X_n$, so that wall charges accumulate around the corresponding electrode lines. In a section (c-d) of a reset period (a-d), 0V is applied to all electrode lines. Accordingly, the wall charges having accumulated on the electrode lines are erased by a self-discharge and space charges are uniformly formed. Here, since each three subfields are allocated to one frame, the same driving method as in the p-th subfield is applied to the subsequent (p+2)th subfield.

To sum up, according to the second embodiment of the present invention, a relatively high discharge voltage is applied to only electrode lines of the corresponding common electrode group in each subfield. Accordingly, since an erase discharge takes place only around the electrode lines of the corresponding common electrode group, the contrast of a screen can be further enhanced. Since a erase discharge voltage Vw is continuously applied to the first common electrode lines $X_1$, $X_4$, . . . and $X_{n-2}$, the second common electrode lines $X_2$, $X_5$ . . . and $X_{n-1}$ and the third common electrode lines $X_3$, $X_6$, . . . and $X_n$, an erase discharge occurs with a constant time interval with respect to all areas in the discharge space. Accordingly, the effect of the erase discharge is maintained and no flicker is generated.

As described above, according to the driving method of the present invention, a relatively high discharge voltage is applied to only electrode lines of the corresponding common electrode group in each subfield. Accordingly, since an erase discharge takes place only around the electrode lines of the corresponding common electrode group, the contrast of a screen can be further enhanced. Also, since the (p+k·j)th common electrode lines are set to be included in the p-th common electrode group, an erase discharge occurs with a constant time interval with respect to all areas in the discharge space. Accordingly, the effect of the erase discharge is maintained and no flicker is generated.

Although the invention has been described with respect to a preferred embodiment, it is not to be so limited as changes and modifications can be made which are within the full intended scope of the invention as defined by the appended claims.

What is claimed is:

1. A method for driving a plasma display panel having a front substrate and a rear substrate facing and spaced apart from each other, and n common electrode lines 1, 2, . . . n, n scan electrode lines, and m address electrode lines arranged between the front and rear substrates (where m and n are integers greater than 1), the common electrode lines and the scan electrode lines being parallel to each other, the address electrode lines being orthogonal to the scan electrode lines, to define pixels at respective intersections of the scan electrode lines and the address electrode lines, the method comprising:

grouping the n common electrode lines into k groups of common electrode lines (where k is an integer greater than 1), the common electrode lines in a p-th group of the k groups of the common electrode lines being the (p+k·j) common electrode lines (where p is an integer, at least 1 and up to k, and j is 0, 1 . . . ((n/k)−1));

dividing a unit frame to be displayed into k subfields; and in a reset period of the p-th subfield, applying an erase discharge voltage to the common electrode lines of the p-th group of common electrode lines only in the p-th subfield of the respective subfields to erase wall charges and establish uniform space charge in all pixels along the common electrode lines of the p-th group of common electrode lines, while applying a sustained discharge voltage, having the same polarity as and lower in magnitude than the erase discharge voltage, to the common electrode lines not in the p-th group of common electrode lines.

2. The method according to claim 1, wherein the respective subfields include the reset period, an address period in which wall charges are formed at selected pixels, and a sustain-discharge period in which a display discharge occurs with respect to the pixels having wall charges formed in the address period.

* * * * *